United States Patent [19]

Moskowitz

[11] 4,108,649

[45] Aug. 22, 1978

[54] CEMENTED TITANIUM CARBIDE TOOL FOR INTERMITTENT CUTTING APPLICATION

[75] Inventor: David Moskowitz, Southfield, Mich.

[73] Assignee: Ford Motor Company, Dearborn, Mich.

[21] Appl. No.: 730,098

[22] Filed: Oct. 6, 1976

Related U.S. Application Data

[62] Division of Ser. No. 634,972, Nov. 24, 1975, Pat. No. 4,019,874.

[51] Int. Cl.[2] ..... B22F 3/00; B22F 1/00

[52] U.S. Cl. ..... 75/203; 75/205; 75/211; 75/225

[58] Field of Search ..... 75/203, 205, 211, 225

[56] References Cited

U.S. PATENT DOCUMENTS

| | | | |
|---|---|---|---|
| 3,492,101 | 1/1970 | Prill et al. | 29/182.7 |
| 3,679,442 | 7/1972 | Bergna | 29/182.7 |
| 3,741,733 | 6/1973 | Kieffer | 29/182.7 |
| 3,981,062 | 9/1976 | Moskowitz et al. | 29/182.7 |

*Primary Examiner*—Brooks H. Hunt

*Attorney, Agent, or Firm*—Joseph W. Malleck; Olin B. Johnson

[57] ABSTRACT

A hard sintered carbide composition and the method of making such composition for use as a cutting material or for use as wear parts or dies and the like, is disclosed. The composition consists essentially of a titanium carbide phase bound together by a binding alloy principally composed of molybdenum and nickel; the titanium carbide contains controlled amounts of dissolved vanadium carbide and/or titanium nitride. The binding alloy is characterized by the addition of aluminum in controlled amounts and chromium may be added to the binding alloy as a partial substitute for some of the aluminum. The presence of the dissolved vanadium carbide and/or titanium nitride produces a grain refinement in the carbide phase and the presence of the aluminum tends to form a nickel aluminide in the binding alloy which is of a finely divided character. The presence of two or more of the elements; vanadium carbide, titanium nitride and aluminum produce an unprecedented improvement in the deformation resistance of a TiC—Ni—Mo composition.

The method requires that the binding alloy powder and the carbide powders be selected as to size (about 3–4 microns) be milled with the additive powders and the compacted charge then be sintered at about 1400° C in closed graphite trays in a furnace evacuated to less than 1 micron of mercury pressure.

1 Claim, 7 Drawing Figures

CEMENTED TITANIUM CARBIDE TOOL FOR INTERMITTENT CUTTING APPLICATION

This is a division of application Ser. No. 634,972, filed Nov. 24, 1975, now U.S. Pat. No. 4,019,874

BACKGROUND OF THE INVENTION

Cemented carbides are well known for their unique combination of hardness, strength and abrasion resistance and are accordingly extensively used in industry as cutting tools, drawing dies and wear parts. They are produced by powder melaltingy techniques from one or more refractory carbides of Groups IV, V, and VI of the periodic table, and are bonded or cemented together by liquid phase sintering with one or more of the iron group metals. However, it is important to appreciate that certain problems associated with one group of the periodic table do not appear in connection with the other groups of the periodic table. It is true that group IV of the metal carbides (titanium carbide, zirconium carbide, hafnium carbide) shown great similarities of microstructure and properties within the group, but are vastly different from the group VI (tungsten carbides, molybdenum carbide, chromium carbide) with respect to crystal structure, physical properties and chemical behavior. For example, there is a tendency for chromium carbides to form further complex carbides in the tungsten carbide-nickel system. There is no similar tendency for chromium to do so with a titanium carbide, nickel-molybdenum system. This distinction between the cemented carbide groups is important since the predictability of solving certain problems within one group cannot necessarily be related to that of the other group.

This invention is concerned with improving the plastic deformation of the cutting edge associated with cemented titanium carbide tools. Plastic deformation is a common mode of failure of these tools, particularly when machining conditions, such as high speed and high feed, produce excessive temperatures at the cutting tip and result in plastic yielding. This is one of the common modes of failure of all carbide tools. This alone provides good reason to improve their deformation resistance, particularly the roughing grade which is most susceptible to this problem. of even greater possible significance, however, is the observation that, in intermittent cutting, local plastic yielding at the cutting edge of a carbide tool can result in tensile stresses at that edge during the cooler, non-cutting part of the cycle, which stresses are large enough to initiate thermal cracks. This being true, inhibiting the cutting edge from deforming plastically is the key step in providing increased resistance to thermal cracking in operations such as milling where severe thermal cycling takes place.

In confirmation of the above, it has been observed that additions of chromium to TiC—Ni—Mo materials improve their deformation resistance as well as their thermal crack resistance. Chromium additions are known to remain essentially in the binding alloy phase of these materials. Increased "stiffness" of the binder phase due to solid solution strengthening by the chromium is the mechanism from which this benefit is derived. It has been shown that aluminum also has a potent effect, similar to but more powerful than chromium, in decreasing nose push (see U.S. Patent Application Ser. No. 575,300, commonly assigned to the same assignee of this application). But such teachings of the prior art are primarily directed to improving the plastic deformation of the binding alloy. It has now become apparent that plastic deformation of the carbide phase may also take place at elevated temperatures encountered during metal cutting. It is to this latter aspect that this invention is directed, as well as an overall improvement in the plastic deformation of the entire composition utilizing materials that work in synergism with the ingredients added to the binding alloy.

An accepter criterion for measuring resistance to plastic deformation at elevated temperatures is the nose push test, referred to below. The nose push test procedure is as follows: a cutting tool is used to machine a cylindrically shaped work piece at a 0.06 inch depth of cut and at a feed of 0.011 inch per revolution for a 2 minute duration. Deformation on the nose of the tool, e.g. nose push, is then measured by running the stylus of a profilometer over the nose of the tool at an angle of 30° to a line drawn normal to the tool flank. Nose push is, in fact, a deflection due to the plastic condition of the tip of the tool. The nose push values are reliably associated with plastic deformation at the elevated temperature reached by the nose of the tool. They increase directly as the cutting speed increases, due to increasing temperature.

Presently used commercial titanium carbide roughing grade compositions typically render an excessive nose push valve while cutting 1045 steel of 180 Brinell hardness at tool speeds of 1000 SFPM, resulting in an undesirable deformation of approximately 0.007 inches. This amount of deformation is not satisfactory and for most metal cutting operations would be considered a failure of cutting edge. Similarly, presently used commercial roughing grade titanium carbide compositions would render an undesirable nose push value in excess of 0.003 inches when cutting 4340 steel of about 300 Brinell hardness at tool speeds of 600 SFPM. Moreover, presently used commercial semi-roughing grades will provide an excessive nose push value over 0.003 inches when cutting 4340 steel of 300 Brinell hardness and at tool speed of 600 SFPM. For commercially used finishing grades, it has been found that a nose push value in excess of 0.001 inches when machining 4340 steel of 300 Brinell hardness at tool speeds of 600 SFPM is undesirable.

SUMMARY OF THE INVENTION

The primary object of this invention is to provide a cemented titanium carbide of the TiC—Ni—Mo system which not only retains excellent tool life or die wear, good hardness, good transverse rupture strength and corrosion resistance, but most importantly exhibits improved resistance to plastic deformation under rigorous cutting use. Such improved resistance to plastic deformation will be exhibited by a nose push value no greater than 0.003 for a roughing grade system when machining 4340 steel having 300 Brinell hardness at tool speeds of 600 SFPM, and a nose push value no greater than 0.001 inches for finishing grade systems when machining 4340 steel of 300 Brinell hardness at tool speeds of 600 SFPM.

Another object of this invention is to provide a sintered titanium carbide which exhibits improvement in both resistance to thermal shock and to plastic deformation over that known to the art, the improvement taking place both in the binding alloy as well as in the carbide matrix, the improvement resulting from the addition of controlled amounts of elements to both the binding alloy as well as the matrix of said system.

Yet still another object of this invention is to provide an improved method of forming cemented carbides of the TiC—Ni—Mo systems, the method facilitating sintering of the cemented carbide at furnace temperatures preferably about 1370°-1400° C, but at least 1350° C (or other high temperatures required to form a liquid phase of all the binding alloy) when the binding alloy contains a low melting ingredient such as aluminum which must be prevented from boiling off as a vapor during sintering and when the matrix contains refractory additives such as vanadium carbide or titanium nitride which must be stabilized in the presence of a vacuum.

SUMMARY OF THE DRAWINGS

FIG. 1 represents data for a typical roughing grade tool, as well as tool modifications based upon prior art knowledge, when machining 1045 steel.

FIG. 3 represents nose push data for a typical roughing grade tool, again having modifications based upon the prior art, when machining 4340 steel.

FIG. 4 represents nose push data for a typical roughing grade tool employing a variety of modifications based upon the invention herein when machining 4340 steel.

FIG. 5 represents a typical roughing grade containing still other modifications based upon the teaching of the invention when machining 4340 steel.

FIG. 6 represents nose push data for a typical semi-roughing grade when employing certain modifications of this invention and when machining 4340 steel.

FIG. 7 represents nose push data for a typical finishing grade tool employing some of the modifications based upon the teaching of this invention when machining b 4340 steel.

DETAILED DESCRIPTION

Figure 1:
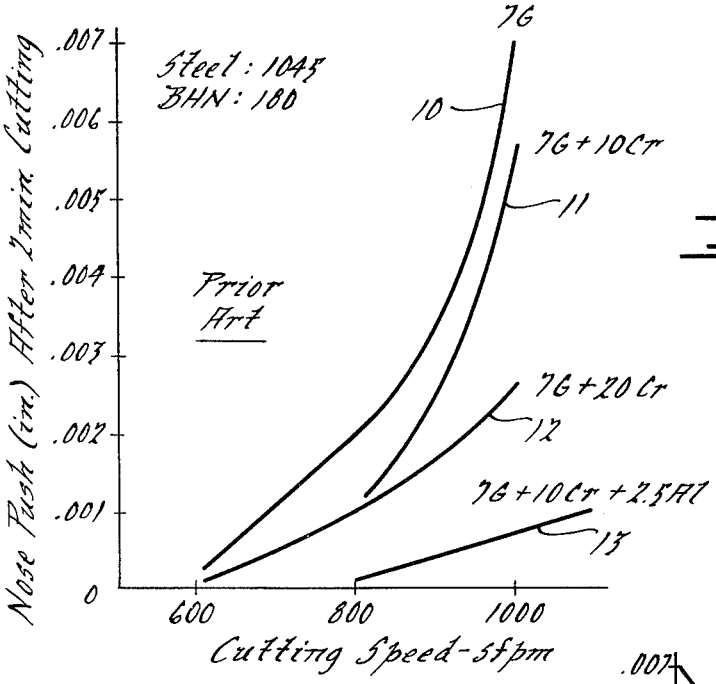
FIGS. 1, 3–7 are each graphical illustrations representing nose push data plotted against the tool cutting speed.
Figure 2:
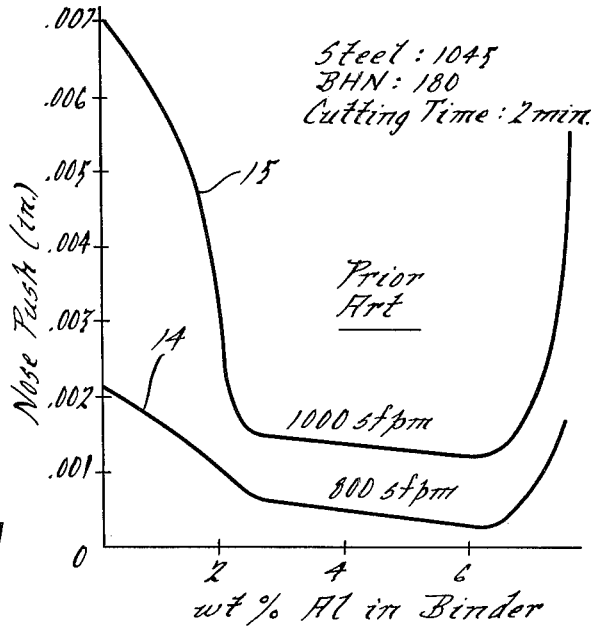
FIG. 2 represents nose push data plotted according to a variation of the aluminum content of a typical roughing grade when machining 1045 steel.
Figure 3:
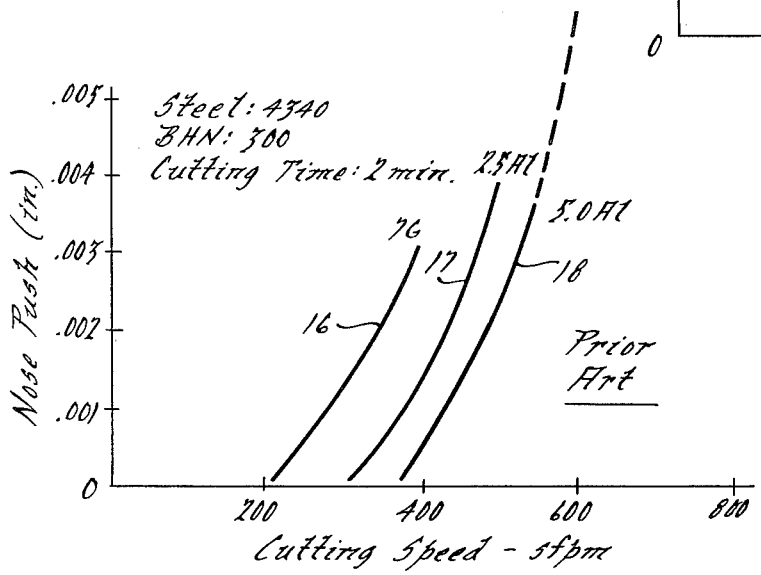

The plastic deformation of pertinent prior art materials are shown in FIGS. 1–3. FIG. 1 shows the effect on nose deformation, commonly called nose push, of chromium additions to a roughing grade of TiC—Ni—Mo cutting material (grade 7G). The 7G grade is a typical roughing grade having the following composition by weight percent: 66.9% TiC, 22.5% Ni, 10.6% $Mo_2C$. All of the tool materials graphically illustrated in FIGS. 1–3 were used to cut 1045 steel of 180 Brinell hardness. Curve 10 represents nose push data vs. cutting tool speed for an unmodified 7G composition. Curve 11 represents a 10% chromium addition to the binding alloy (which is a quantity calculated on top of the percentages as listed above for the standard 7G grade). Curve 12 represents a 20% chromium addition to the binding alloy and curve 13 represents a 10% chromium addition plus a 2.5% aluminum addition to the standard grade. All the nose deformation measurements given were accomplished using the profile tracing method on the tool nose after 2 minutes of machining. Details of the method of determination are described above. The data of FIG. 1 indicates that a small amount of aluminum has a potent effect upon the improvement achieved by the addition of chromium to the binding alloy. The chromium additions thus improve the deformation resistance of the conventional 7G grade by lowering the nose push value from about 0.007 to as little as 0.0025 inches at 1000 SFPM.

FIG. 2 illustrates the effect on nose deformation by additions of aluminum alone in the controlled range of 0 to 7.5% of the binding alloy. At both cutting tool speeds of 800 SFPM (curve 14) and 1000 SFPM (curve 15) it can be seen that there is a sudden drop in nose push until approximately 2.5% aluminum is added, followed by a slight further improvement in the nose push characteristic up to additions of 6.25% aluminum; the curves follow a sharp increase at greater aluminum contents. These improvements are most likely due to solid solution strengthening of the nickel-base binder as well as to strengthening caused by formation of finely dispersed $Ni_3Al$-type particles at higher aluminum levels. The nose push data of FIG. 2 was collected by machining for a period of 2 minutes.

In FIG. 3, notice what happens to nose push data when the same aluminum additions are employed in a typical roughing grade 7 G (plot 16), but this time cutting is against a much harder and stronger steel, 4340 having Brinell hardness of about 300 (the cutting time being for a period of 2 minutes). Instead of a substantially negligible nose push value at 600 SFPM as when machining 1045 steel of 180 BHN, the nose push increases to values in excess of 0.005 inches for 600 SFPM at a 5.0% aluminum addition (plot 18). To meet the requirements of this invention, it is important that the nose push value at 600 SFPM, when machining 4340 steel at 300 Brinell hardness, be no greater than 0.003 for a roughing grade or semi-roughing grade tool. With respect to a finishing grade tool, the nose push data should be no greater than 0.001 inches at 600 SFPM.

Figure 4:
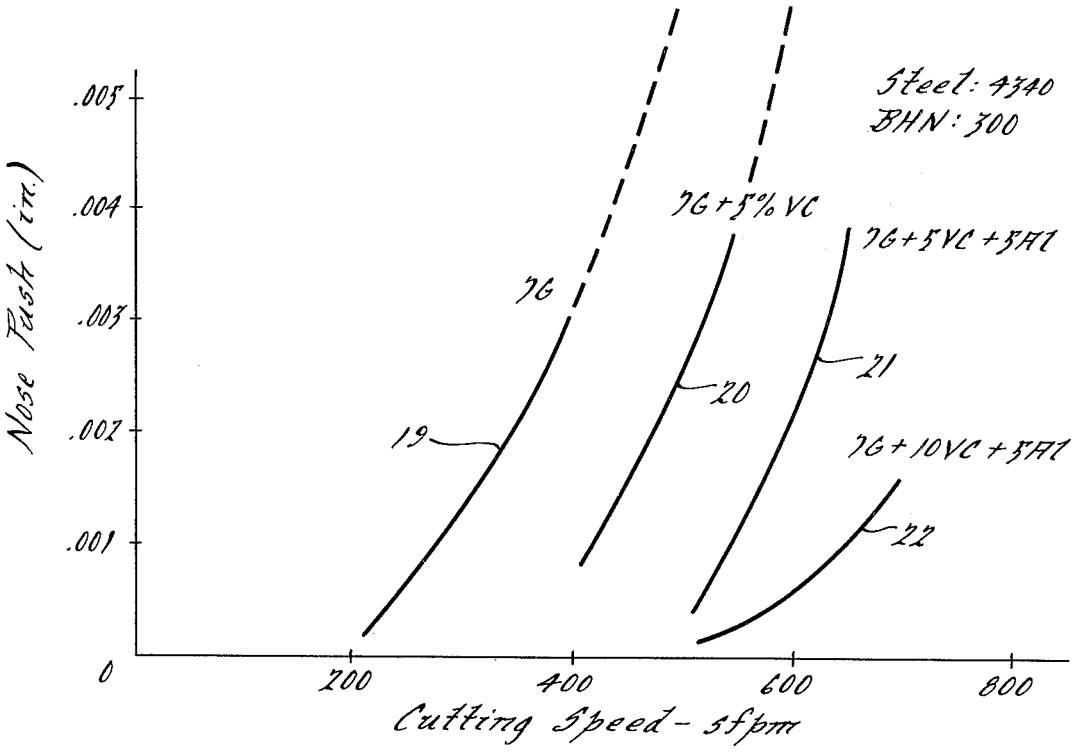

To achieve greater resistance to nose deformation when machining tougher and harder steels, it is necessary that some attention be given to improving the resistance of the carbide matrix in addition to the improvement of the binding alloy as represented by FIGS. 1–3. To this end, vanadium carbide or titanium nitride is added to the titanium carbide matrix to render a solid solution having superior compressive yield strength at elevated temperature, such strength being greater than that for pure titanium carbide. FIG. 4 illustrates the improvement that can be obtained (although not meeting the criteria of this invention) by use of 5% vanadium carbide (plot 20) added to the normal proportions of that already given with respect to a typical cutting grade 7G (plot 19). Some improvement indeed was rendered as illustrated by a nose push value of about 0.003 at 500 SFPM as opposed to a projected nose push value in considerable excess of 0.006 inches at 500 SFPM for a typical 7G grade. However, when variations of 5% and 10% vanadium carbide were added to 5% aluminum, the two elements being added as additions to the normal 7G grade breakdown, the results were significantly improved. At 600 SFPM, a 5% VC plus 5% Al (plot 21) showed a nose push value of 0.0023 and with 10% VC plus 5% Al (plot 22), a nose push value at 600 SFPM of only about 0.0005 inches was obtained. It is theorized, although not actually supported by test data of FIG. 4, that a 10% vanadium carbide addition, without any aluminum, added to a typical 7G would render approximately a 0.0025 inch nose push deformation at 600 SFPM.

The combination of vanadium carbide and aluminum as an addition showed the greatest improvement in nose push, since both the binder as well as the carbide phase was strengthened; the effects appear to be cumulative.

Another additive that has been discovered to be beneficial with respect to nose deformation resistance and which can be added to the matrix, is titanium nitride (TiN).

Figure 5:
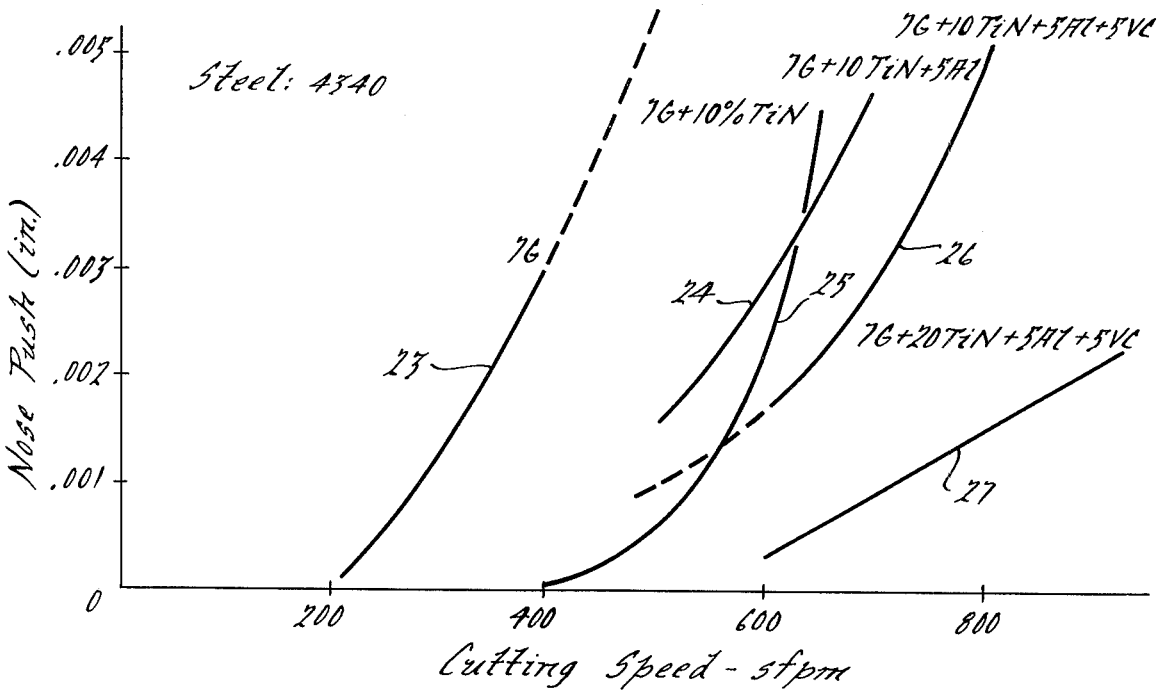

Titanium nitride will go into solid solution will the titanium carbide during sintering, similar to the way vandium carbide behaves. However, titanium nitride has a distinct grain refining effect on the carbide phase. This is evident from examination of electron-photomicrographs of specimens to which titanium nitride additions have been made. As shown in FIG. 5, a 10% addition (plot 25 ) to a typical 7G cutting grade, when used to machine 4340 steel with a 300 Brinell hardness, shows that it is possible to machine at speeds over 200 SFPM higher than the unalloyed 7G (plot 23). However, the value at 600 SFPM, with only a 10% titanium nitride addition is still in excess of that desired in accordance with the standards of this invention.

In FIG. 5, it is shown that a 10% titanium nitride addition enables one to machine 4340 steel at speeds of 600 SFPM with a nose push deformation of only 0.0023 inches. Through addition of 5% aluminum over and above 10% TiN, (plot 24) there is little further improvement. However, with the same level of aluminum and titanium nitride, and with the further addition of 5% vanadium carbide (plot 26), there is further improvement whereby at 600 SFPM a nose push value of 0.0018 is achieved. Increasing the TiN content to 20% (plot 27) while retaining the other additives the same as in plot 26, shows still further improvement with the nose push value of about 0.0005 at 600 SFPM.

The effects described above with respect to FIGS. 4 and 5 all relate to the use of a roughing grade titanium carbide (TiC—Ni—Mo) system. Worthwhile improvements with respect to increasing resistance to nose push were obtained for a semi-finishing grade typically designated 5H.

Figure 6:
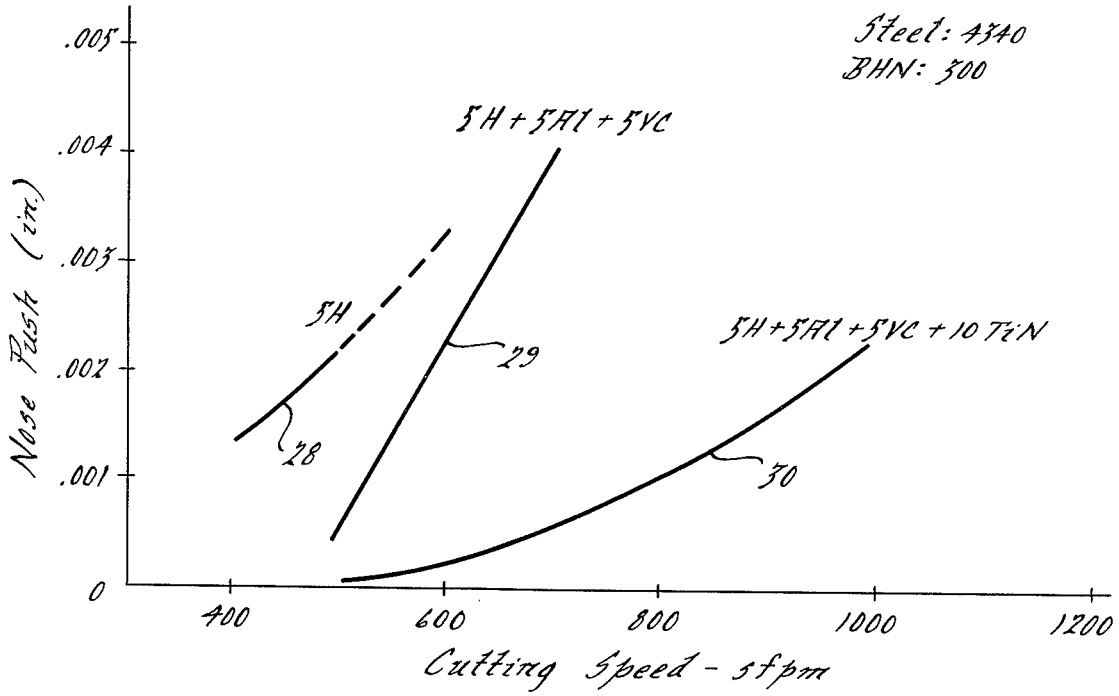

Turning to FIG. 6, a semi-finishing grade was employed giving a base reference curve 28. A 5H grade preferentially comprises 73.5 TiC, 17.5% Ni, 9.0% $Mo_2C$. When 5% aluminum and 5% vanadium carbide were added to the typical 5H composition (plot 29), a nose push value of about 0.0023 inches was obtained at 600 SFPM; when the 5H composition was modified using all three additives taught herein, namely 5% aluminum, 5% vanadium carbide and 10% TiN (plot 30), the nose push value is extremely low, 0.0002 inches at 600 SFPM. Moreover, the latter composition did not undergo sizable deformation until a 1000 SFPM speed was reached.

Figure 7:
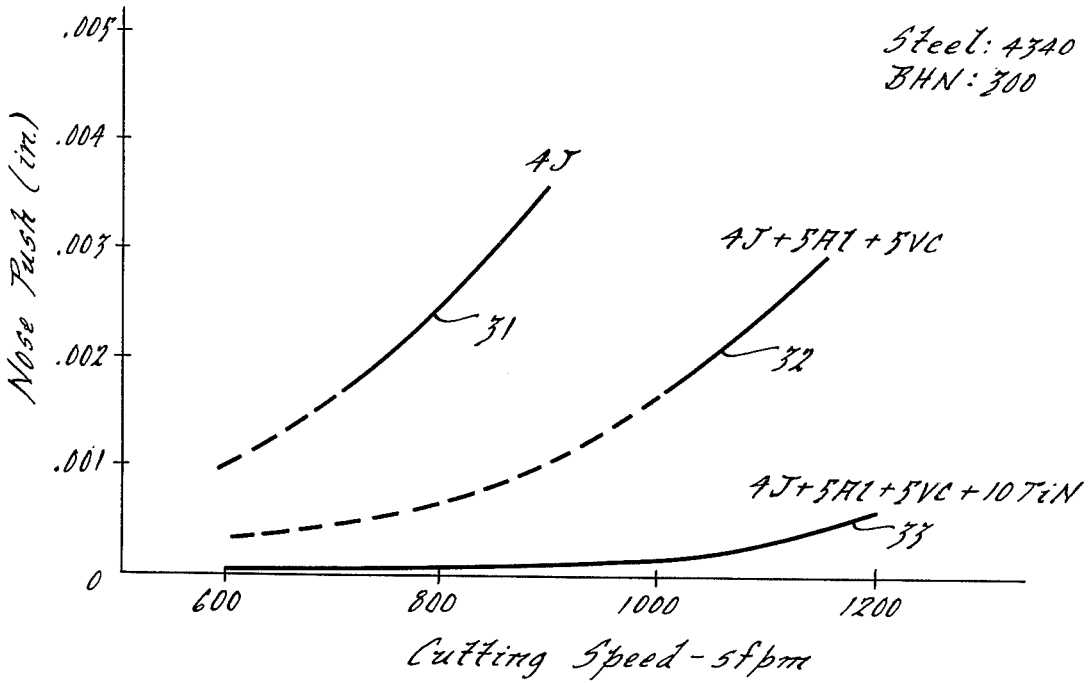

In FIG. 7, comparable nose push data was obtained for a finishing grade of cemented titanium carbide, commonly referred to as 4J and typically consisting essentially of 75.9 TIC, 12.5% Ni, 11.0% Mo, and 0.6% graphite. The base reference curve 31, utilizing an unmodified 4J composition, showed that at cutting speeds of 600 SFPM a nose push value of slightly less than 0.001 inch was obtained. However, with the addition of 5% aluminum and 5% vanadium carbide (plot 32) and especially for the modification (plot 33) employing three additions (5% aluminum, 5% vanadium carbide and 10% titanium nitride), the nose push data was extremely low even at speeds up to 1000 SFPM. At speeds of 600 SFPM the nose push value was less than the unmodified grade. Greater clarity is observed at speeds in excess of 800 SFPM in fact the fully modified 4J grade (plot 33) allowed machining up to a cutting speed of 1200 SFPM with very little deformation.

Accordingly, it is concluded by the data generated in connection with this invention that either the employment of vanadium carbide or titanium nitride in controlled amounts will strengthens the matrix of the cemented carbide. It is essential to employ a small amount of aluminum in conjunction with the use of vanadium carbide or titanium nitride to insure that both the binding alloy and the matrix produce deformation improvement. With titanium nitride, the necessity for the addition of aluminum is not as clear cut as for the case of vanadium carbide. Nonetheless, the combination of all three elements, aluminum, vanadium carbide and titanium nitride in controlled amounts illustrate the greatest synergistic improvement when used as a group.

The following table gives the overall ranges of addition over which each of the above additives, taken individually, have been found to improve the deformation resistance of TiC—Ni—Mo compositions. Also listed are the preferred ranges of addition for all three additives when made in combination and which produces the greatest improvement.

| Additive | Overall Range of Addition (Wt. %) | Preferred Range of Addition (Wt. %) |
|---|---|---|
| Al | 2.5–7.5* | 2.5–5.0* |
| VC | 5–20 | 5–10 |
| TiN | 2.5–20 | 5–10 |

*Weight percent of binder

A preferred method of sequence is as follows:

(1) A powder charge is prepared by blending together a titanium carbide powder, a binding alloy powder containing nickel and molybdenum and additive powders no greater than 22.5% the charge. The additive powders have a particle size of about −325 mesh whereas the titanium carbide powder has a size in the range of 3.5–4.5 microns. It is preferred that the aluminum addition be made via a nickel-coated aluminum powder having a mesh size of about −325.

(2) The charge is mechanically blended and is milled in the presence of a wax lubricant and a cemented carbide media, along with an evaporative agent for about 4 days; the evaporative agent is completely volatilized and the resulting dry charge is passed through a 20 mesh sieve.

(3) The milled and mechanically blended charge is subjected to compressive forces in the range of 8–12 tsi and then heated to dewax the compact under a dry hydrogen atmosphere for a period of 1 hour at 670° C.

(4) A closed graphite tray is prepared into which the compact is inserted; the tray is evacuated to less than 1 micron of mercury pressure and the interior of the closed tray is heated to a temperature of about 1400° C or to a temperature of at least 150° C in excess of the eutectic temperature of any combination of said powders. The vapor pressure of aluminum at the usual sintering temperatures of cemented carbides is so great that little or none can be retained if vacuum sintering were carried out in open graphite trays, as is the normal practice. The use of closed graphite trays allows the equilibrium vapor pressure of aluminum to be reached within the enclosed volume containing the compact without any significant further loss of aluminum. The sintering atmosphere can thus be thought of as consisting of aluminum vapor at its equilibrium vapor pressure at the sintering temperature.

I claim:

1. A method of making a sintered compact useful as a cutting tool and having improved nose push resistance and increased grain refinement, the method comprising:

(a) blending together a titanium carbide powder, nickel-coated aluminum powder, at least one of molybdenum powder and molybdenum carbide powder, an additive powder having vanadium carbide and titanium nitride, (b) milling said powders in the presence of a waxy lubricant, cemented carbide media, and acetone for a sufficient time to achieve thorough homogeneity and blending, (c) drying said blended powders and screening to −20 mesh, (d) compacting said screened blended powders under a force between 16,000 and 24,000 psi and heating to dewax said compact under a dry hydrogen atmosphere, and (e) preparing closed graphite trays and inserting said compacted powders thereinto while evacuating the furnace and holding trays to less than one micron mercury, sintering said compact and said close graphite trays at a temperature of about 1400° C for a period of about 1 hour.

* * * * *